US009381978B1

(12) United States Patent
Lottman

(10) Patent No.: US 9,381,978 B1
(45) Date of Patent: Jul. 5, 2016

(54) WATERCRAFT WITH LIFTING APPARATUS

(71) Applicant: Matt Lottman, Nisswa, MN (US)

(72) Inventor: Matt Lottman, Nisswa, MN (US)

(73) Assignee: Matt Lottman, Nisswa, MN (US)

( * ) Notice: Subject to any disclaimer, the term of this patent is extended or adjusted under 35 U.S.C. 154(b) by 0 days.

(21) Appl. No.: 14/597,148

(22) Filed: Jan. 14, 2015

Related U.S. Application Data

(60) Provisional application No. 61/928,039, filed on Jan. 16, 2014.

(51) Int. Cl.

| | |
|---|---|
| ***B63B 27/00*** | (2006.01) |
| ***B63B 27/16*** | (2006.01) |
| ***B66C 23/52*** | (2006.01) |
| ***B63B 27/36*** | (2006.01) |
| ***B66C 23/53*** | (2006.01) |

(52) U.S. Cl.
CPC ..... *B63B 27/16* (2013.01); *B63B 27/36* (2013.01); *B66C 23/52* (2013.01); *B66C 23/53* (2013.01); *B63B 2241/20* (2013.01)

(58) Field of Classification Search
CPC ..... B63B 27/04; B63B 27/14; B63C 23/52
USPC ..... 114/268; 212/227, 230, 231, 307, 309, 212/308
See application file for complete search history.

(56) References Cited

U.S. PATENT DOCUMENTS

| | | | | |
|---|---|---|---|---|
| 3,390,657 A * | 7/1968 | Schneider | B63B 27/12 | 114/260 |
| 6,145,680 A * | 11/2000 | Jussila | B66C 15/00 | 212/274 |
| 6,491,174 B1 * | 12/2002 | Day | B66C 23/52 | 212/179 |

* cited by examiner

*Primary Examiner* — Stephen Avila
(74) *Attorney, Agent, or Firm* — Michael A. Bondi; Moss & Barnett

(57) ABSTRACT

A watercraft with lifting apparatus including a watercraft and a lifting apparatus. The lifting apparatus includes a frame, a lift frame assembly, a first engagement mechanism, a second engagement mechanism and a pivot mechanism. The frame is mounted to the watercraft. The lift frame assembly has a first end and a second end. The first engagement mechanism is capable of causing the first end of the lift frame assembly to engage the frame. The second engagement mechanism is capable of causing the second end of the lift frame assembly to engage the frame. The pivot mechanism causes the lift frame assembly to pivot with respect to the frame.

19 Claims, 9 Drawing Sheets

WATERCRAFT WITH LIFTING APPARATUS

REFERENCE TO RELATED APPLICATION

This application claims priority to U.S. Provisional Application No. 61/928,039, which was filed on Jan. 16, 2014, the contents of which are incorporated herein by reference.

FIELD OF THE INVENTION

The invention relates to watercraft. More particularly, the invention relates to a watercraft for placing objects into water and/or removing objects from water.

BACKGROUND OF THE INVENTION

In many situations, it is desirable to place objects into water or remove objects from water where the objects are sufficiently large such that it is not possible to manually lift the objects.

For example, in certain regions water freezes during the winter, it is desirable to remove objects such as docks and boat lifts from the water during the winter so that these objects do not get damaged by the ice.

Examples of mechanical systems that may be used to place objects into water or remove objects from water are discussed in the following patents.

SUMMARY OF THE INVENTION

An embodiment of the invention is directed to a watercraft with lifting apparatus that includes a watercraft and a lifting apparatus. The lifting apparatus includes a frame, a lift frame assembly, a first engagement mechanism, a second engagement mechanism and a pivot mechanism.

The frame is mounted to the watercraft. The lift frame assembly has a first end and a second end. The first engagement mechanism is capable of causing the first end of the lift frame assembly to engage the frame. The second engagement mechanism is capable of causing the second end of the lift frame assembly to engage the frame. The pivot mechanism causes the lift frame assembly to pivot with respect to the frame.

Another embodiment of the invention is directed to a watercraft with lifting apparatus that includes a watercraft and a lifting apparatus. The lifting apparatus includes a frame, a lift frame assembly, first and second lift arms, a first engagement mechanism, a second engagement mechanism, a pivot mechanism and a ballast arm assembly.

The frame is mounted to the watercraft. The lift frame assembly has a first end and a second end. The first and second lift arms are operably mounted with respect to the lift frame assembly for movement between a retracted position and an extended position.

The first engagement mechanism is capable of causing the first end of the lift frame assembly to engage the frame. The second engagement mechanism is capable of causing the second end of the lift frame assembly to engage the frame. The pivot mechanism causes the lift frame assembly to pivot with respect to the frame. The ballast arm assembly is slidably and pivotally mounted with respect to the frame.

Another embodiment of the invention is directed to a method of moving objects using a watercraft with lifting apparatus. A watercraft is provided. A lifting apparatus is provided that includes a frame, a lift frame assembly, a first engagement mechanism, a second engagement mechanism and a pivot mechanism, wherein the lift frame assembly has a first end and a second end.

The frame is attached to the watercraft. The first engagement mechanism engages the first end of the lift frame assembly and the frame or the second engagement mechanism engages the second end of the lift frame assembly and the frame. The lift frame assembly is pivoted with respect to the frame using the pivot mechanism to cause the lift frame assembly to lift an object.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
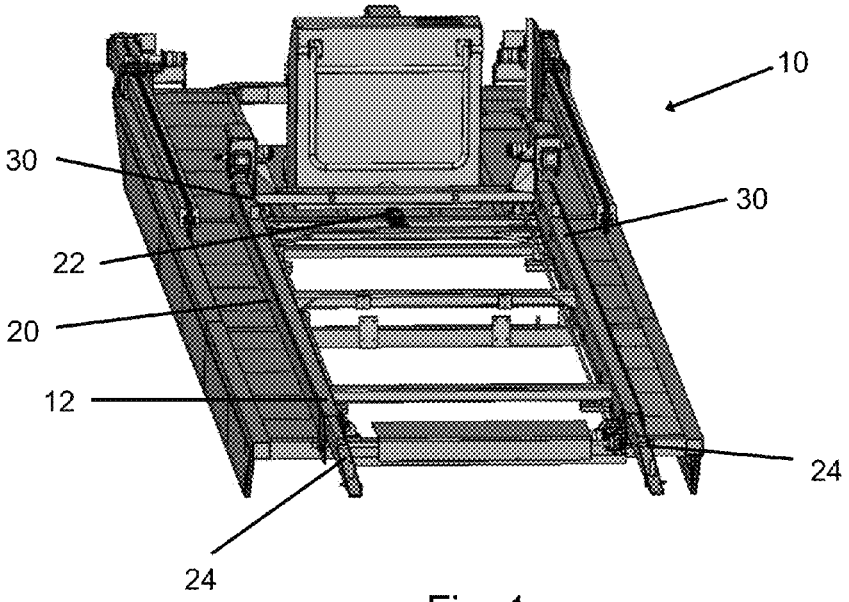
FIG. 1 is a front view of a watercraft with a lifting apparatus where the lifting apparatus is in a lowered configuration.

An embodiment of the invention is directed to a watercraft 10 with lifting apparatus 12 as illustrated in FIGS. 1-4. The watercraft 10 with lifting apparatus 12 enables objects to be quickly and easily put into water and removed from water while minimizing the need for a person to get into the water.

The watercraft 10 may take a variety of forms using the concepts of the invention. In certain embodiments, the watercraft 10 is a pontoon boat that includes two flats and a platform that extends between the floats.

The watercraft 10 is formed with a length and a width that are sufficiently large such that the lifting apparatus can be mounted thereto. In certain embodiments, at least one of the length or the width of the watercraft is larger than a length or a width of the lifting apparatus 12.

The watercraft 10 is selected with sufficient buoyancy such that the watercraft can not only support the weight of the lifting apparatus 12 but also the weight of the object that is intended to be lifted with the lifting apparatus 12 without the watercraft 10 being submerged in the water.

The lifting apparatus 12 generally includes a lift frame assembly 20, a pivot mechanism 22 and lift arms 24. In certain embodiments, the lifting apparatus 12 also includes a frame 26 that facilitates attachment of the lifting apparatus 12 to the watercraft 10. The frame 26 thereby enables the lifting apparatus 12 to be fully assembled and then attached to the watercraft 10. Such a configuration enables the lifting apparatus 12 to be attached to alternative watercraft 10 such as depending on the weight of the object that is intended to be lifted with the lifting apparatus 12.

The lift frame assembly 20 includes a pair of side rails 30. In certain embodiments, the side rails 30 are mounted in a spaced-apart configuration. The side rails 30 may have a square profile with a channel extending down the center thereof. This channel is adapted to receive the lift arm 24 as is discussed in more detail herein.

The side rails 30 are interconnected with at least one end rail 32. In certain embodiments, there are two end rails 32 positioned at opposite ends of the side rails 30 to interconnect the side rails 30.

The lift frame assembly 20 also includes a center rail 34 that is mounted proximately in the middle of the end rails 32. The center rail 34 is utilized for pivoting the lift frame assembly 20.

The lift frame assembly 20 is fabricated from relatively strong materials that resist deformation or breakage when the lifting apparatus 12 is used to placed objects into water or remove objects from water. In certain embodiments, the lift frame assembly 20 is fabricated from metallic material such as steel.

Proximate a center of the side rails 30, a reinforcing plate 36 may be attached thereto on an outer surface thereof. The reinforcing plate 36 enhances the strength of the side rails 30 to thereby reduce the potential of the side rails 30 bending.

Pivoting of the lift frame assembly 20 with respect to the frame 26 is accomplished by a hydraulic cylinder 40. Opposite ends of the hydraulic cylinder 40 are attached to the center rail 34 and the frame 26. A person of skill in the art will appreciate that alternate mechanisms may be used to pivot the lift frame assembly 20. An advantage of the hydraulic cylinder 40 is its reliability of operation.

The hydraulic cylinder 40 is operably connected to a hydraulic pump that is connected to a motor 42. The motor 42 is attached to the frame 26. A cover 44 may be provided that extends over a portion of the motor 42 to protect the motor 42 from damage as well as to minimize the potential of human injury caused by contact with the components of the motor 42.

A control system 46 operably connects the motor 42 and the hydraulic cylinder 40. In certain embodiments, the control system 46 includes a plurality of levers. The control system 46 may be mounted proximate to the watercraft controls, which are positioned to minimize interference with the lifting apparatus 12.

The lift frame assembly 20 includes an engagement mechanism 50 proximate each end thereof. When the lift frame assembly 20 is in the lowered configuration, the engagement mechanism 50 at both ends of the lift frame assembly 20 may be engaged to prevent the lift frame assembly 20 from tilting.

Figure 3:
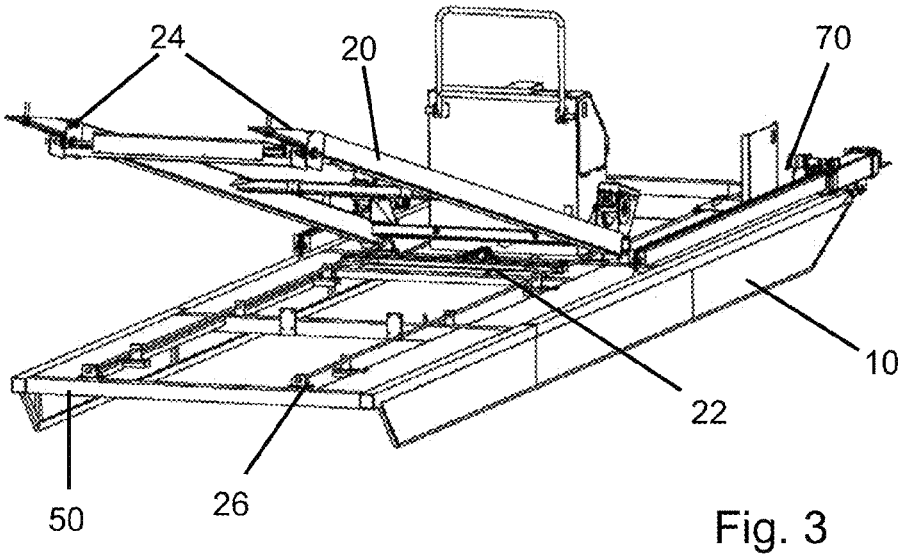
FIG. 3 is a front perspective view of the watercraft with lifting apparatus where the lifting apparatus is in a front elevated configuration.
Figure 4:
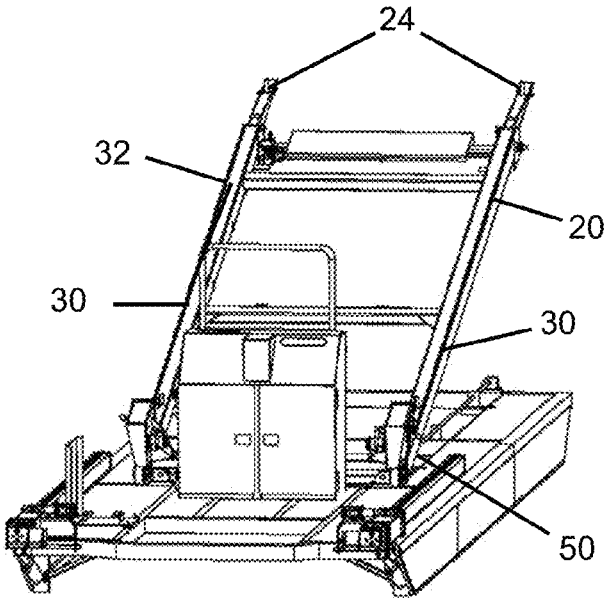
FIG. 4 is a back view of the watercraft with lifting apparatus where the lifting apparatus is in the front elevated configuration.

When it is desired to raise the front end of the lift frame assembly 20, as illustrated in FIG. 3, the engagement mechanism 50 at the front end of the lift frame assembly 20 is disengaged and the engagement mechanism 50 at the rear end of the lift frame assembly 20 is engaged. Thereafter, extension of the hydraulic cylinder 40 causes the front end of the lift frame assembly 20 to be raised.

Figure 9:
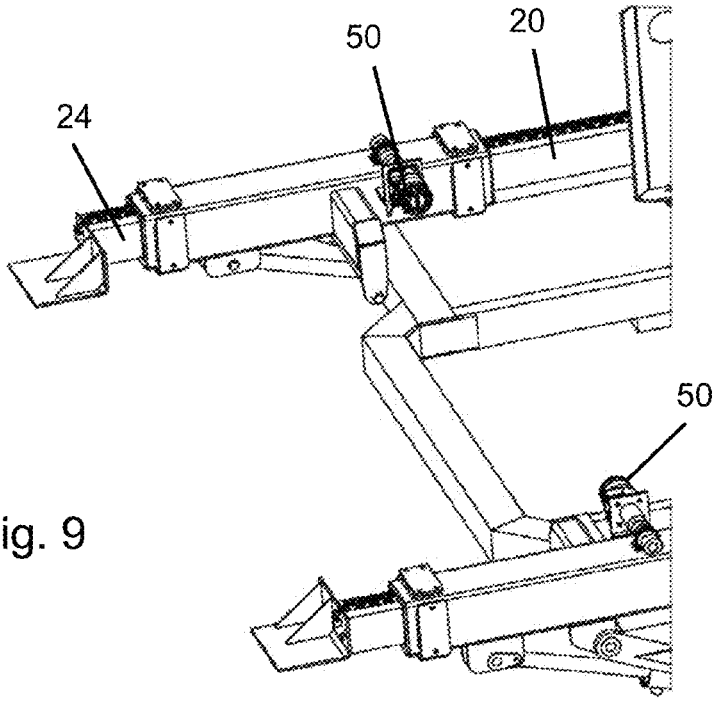
FIG. 9 is a perspective view of the attachment of the lift arm assembly to a frame on the watercraft with lifting apparatus.

When it is desired to lower the front end of the lift frame assembly 20, as illustrated in FIG. 9, the engagement mechanism 50 at the front end of the lift frame assembly 20 is engaged and the engagement mechanism 50 at the rear end of the lift frame assembly 20 is disengaged. Thereafter, extension of the hydraulic cylinder 40 causes the rear end of the lift frame assembly 20 to be raised and such motion causes the front end of the lift frame assembly 20 to be submerged in the water.

Engagement and disengagement of the engagement mechanism 50 may be controlled by the hydraulic system. Using such a configuration allows rapid engagement and disengagement of the engagement mechanism 50.

Figure 5:
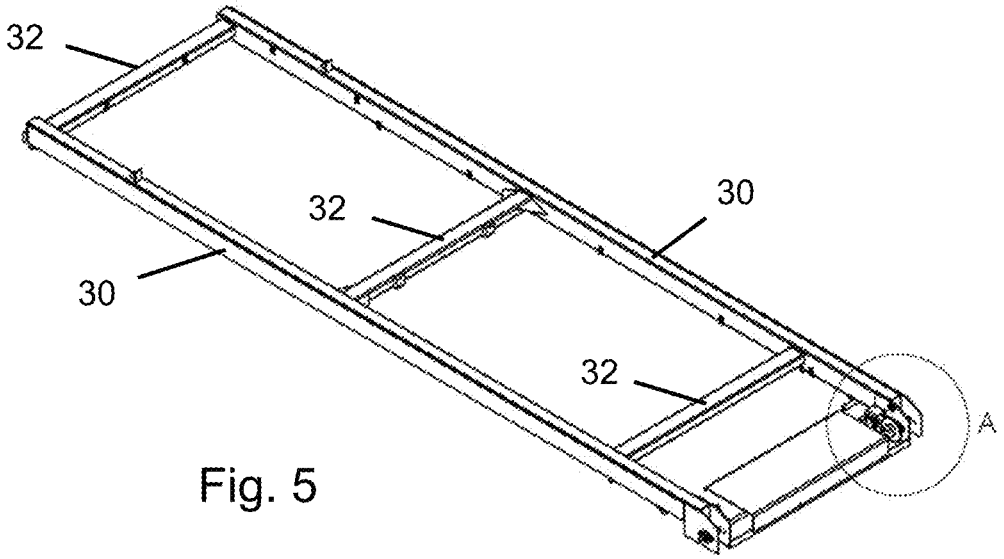
FIG. 5 is a perspective view of a lift frame assembly for the lifting apparatus.

A lift arm drive apparatus 52 is attached to at least one of the side rails 30, as illustrated in FIG. 5. The lift arm drive apparatus 52 causes the lift arms 24 to slide with respect to the side rails 30 between a retracted position and an extended position. In certain embodiments, the lift arm drive apparatus 52 on each of the side rails 30 are interconnected such as with a shaft 54.

Figure 6:
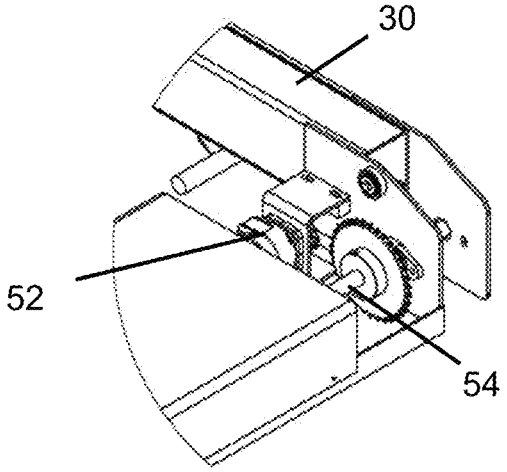
FIG. 6 is a perspective view of a lift arm drive apparatus of the lift frame assembly.

The lift arm drive apparatus 52 may include a hydraulic motor 56, as illustrated in FIG. 6, that operably engages the lift arm 24 to cause the lift arm 24 to move. Operation of the hydraulic motor 56 may be controlled by the control system 46.

Figure 7:
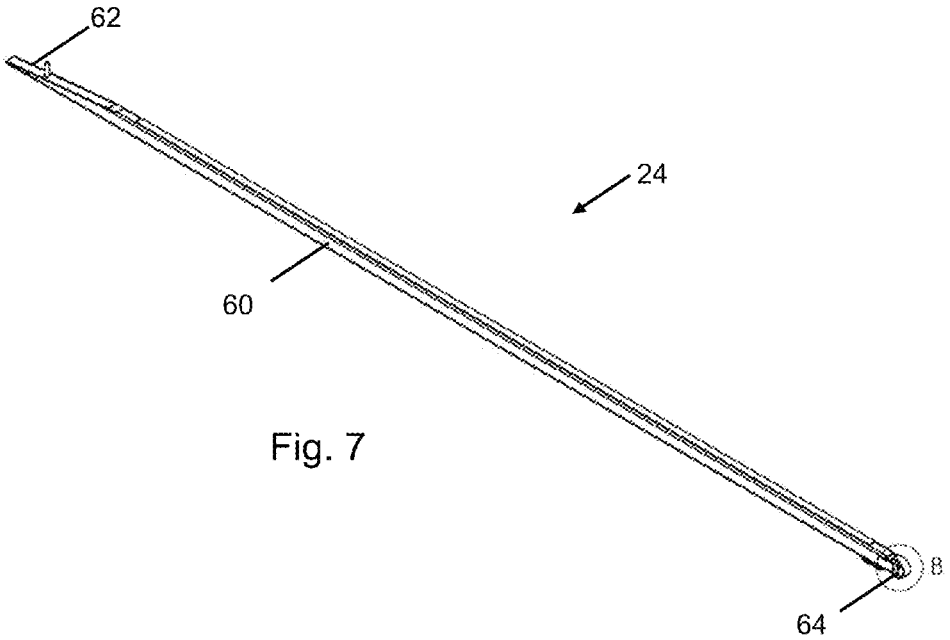
FIG. 7 is a perspective view of a lift arm of the lift frame assembly.

Each of the lift arm 24 has a central region 60, a tip region 62 and a caster assembly 64, as illustrated in FIG. 7. The central region 60 has an outer profile that is smaller than but shaped similarly to the channel that extends through the side rails 30.

The tip region 62 has a length that is less than the length of the central region 60 and tapers from a height that is approximately the same as the height of the central region 60 to a height that is less than the height of the central region 60 at an end of the tip region 62 that is opposite the central region 62. The tip region 62 may facilitate digging under an object that is to be lifted.

Figure 8:
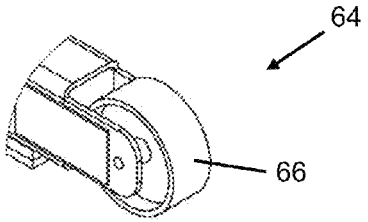
FIG. 8 is a perspective view of a caster wheel assembly of the lift frame assembly.

The caster assembly 64 includes a wheel 66, which is illustrated in FIG. 8, that is rotatably mounted thereto. The wheel 66 may have a height that is greater than the height of the central region 60 and approximately the same as the height of the channel in the side rail 30. The caster assembly 64 thereby reduces the friction associated with the lift arm 24 sliding with respect to the side rail 30.

The lifting apparatus 12 may also include at least one ballast arm assembly 70 operably attached thereto. The ballast arm assembly 70 extends into the water and contacts a ground surface beneath the water to provide the watercraft 10 with enhanced stability during the lifting process.

Figure 2:
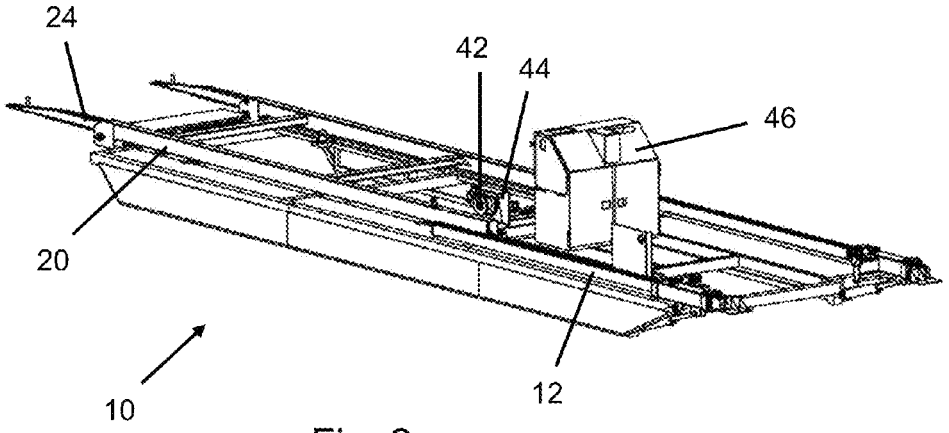
FIG. 2 is a back perspective view of the watercraft with lifting apparatus where the lifting apparatus is in the lowered configuration.

When not in use, the ballast arm assembly 70 may be lowered to a configuration that is generally parallel to the surface of the lifting apparatus 12, as illustrated in FIG. 2. FIG. 3 illustrates the ballast arm assemblies 70 being pivoted upwardly to a configuration that will be generally perpendicular to the surface of the lifting apparatus.

Figure 10:
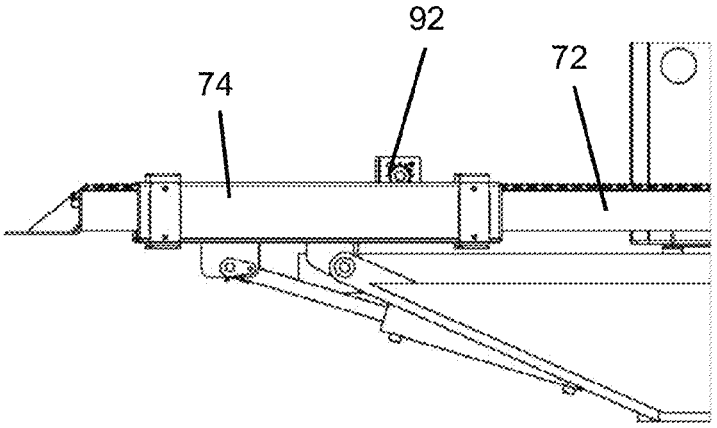
FIG. 10 is a perspective view of a ballast arm assembly attached to the watercraft with lifting apparatus.
Figure 11:
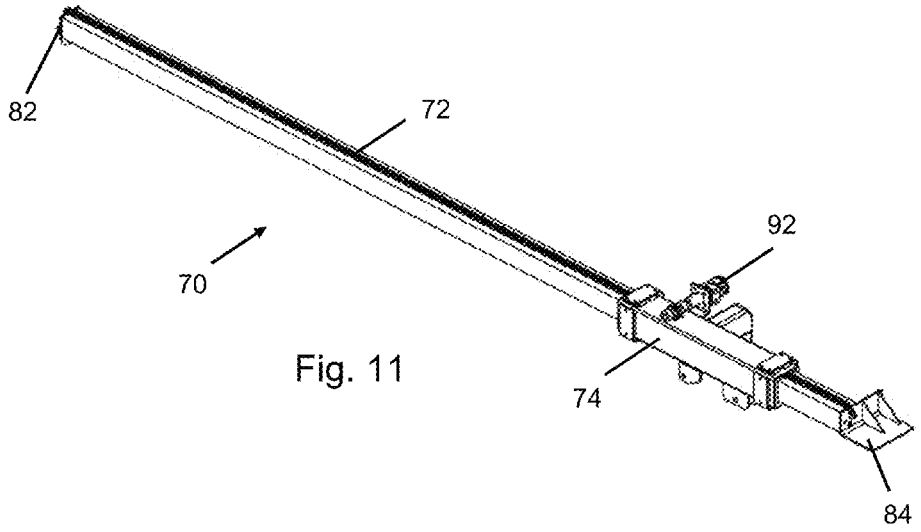
FIG. 11 is a perspective view of the ballast arm assembly.

FIG. 10 illustrates the attachment of the ballast arm assembly 70 to the lifting apparatus 12. The ballast arm assembly 70 generally includes a ballast arm 72 and a ballast arm mounting mechanism 74, as illustrated in FIG. 11.

Figure 12:
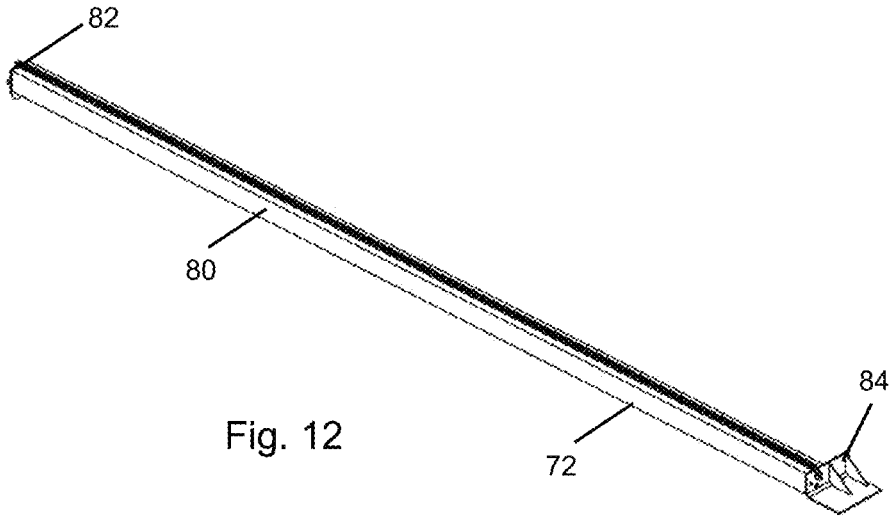
FIG. 12 is a perspective view of a ballast arm of the ballast arm assembly.
Figure 13:
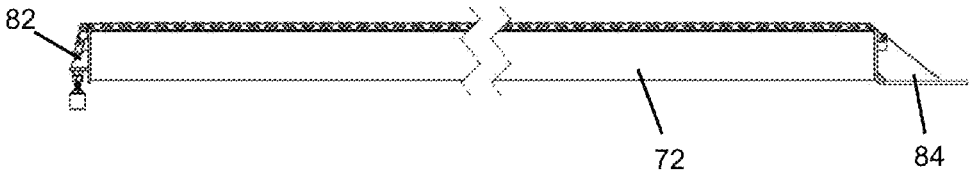
FIG. 13 is a side view of the ballast arm of FIG. 12.

The ballast arm 72 includes a central region 80, a first end region 82 and a second end region 84, as illustrated in FIGS. 12 and 13. The central region 80 has an elongated configuration. In certain embodiments, the central region 80 has a substantially square profile that is similar to the profile of a channel that extends through the ballast arm mounting mechanism 74, as is discussed in more detail herein. A height and a width of the central region 80 are similar to but smaller than a height and a width of the channel in the ballast arm mounting mechanism 74

Figure 14:
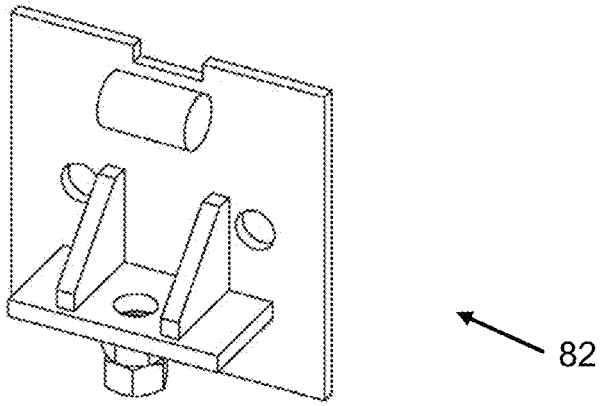
FIG. 14 is an upper perspective view of a ballast cylinder mount.

The first end region 82 is attached to a first end of the central region 80. The first end region 82 has a plate 90 extending therefrom, as illustrated in FIG. 14 to which a chain 92 is attached, as discussed in more detail herein. The first end region 82 also includes a guide 94 extending therefrom. An outer surface of the guide 94 is curved. The chain 92 passes over the guide 94 and is attached to the plate 90. The guide 94 thereby prevents the chain 92 from kinking when passing over the top edge of the first end region 82.

The second end region 84 is attached to a second end of the central region 80 that is opposite the end to which the first end region 82 is attached. While the ballast arm assembly 70 is extended, the second end region 84 is adapted to engage the ground beneath the water to thereby restrict movement of the watercraft 10 in the water.

Figure 15:
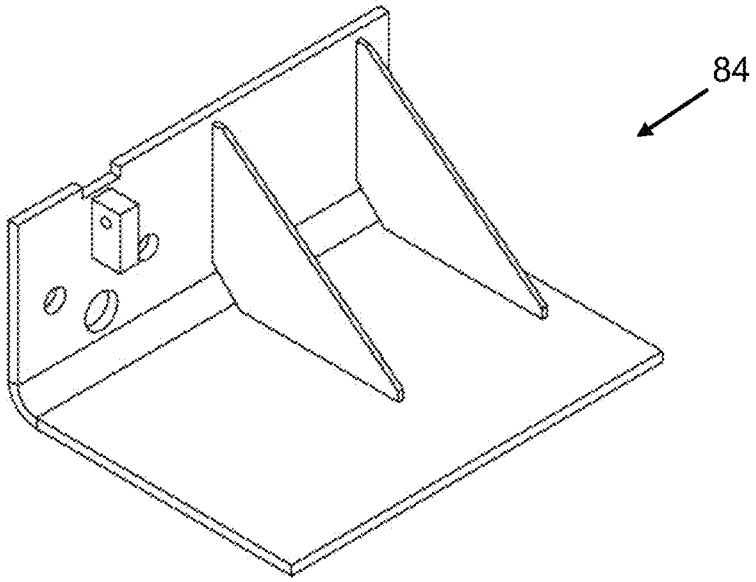
FIG. 15 is a lower perspective view of the ballast cylinder mount of FIG. 14.
Figure 16:
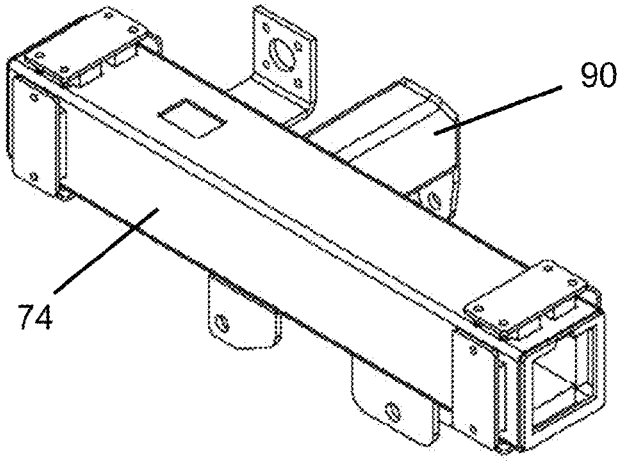
FIG. 16 is a first perspective view of a ballast end cover assembly of the ballast arm assembly.
Figure 17:
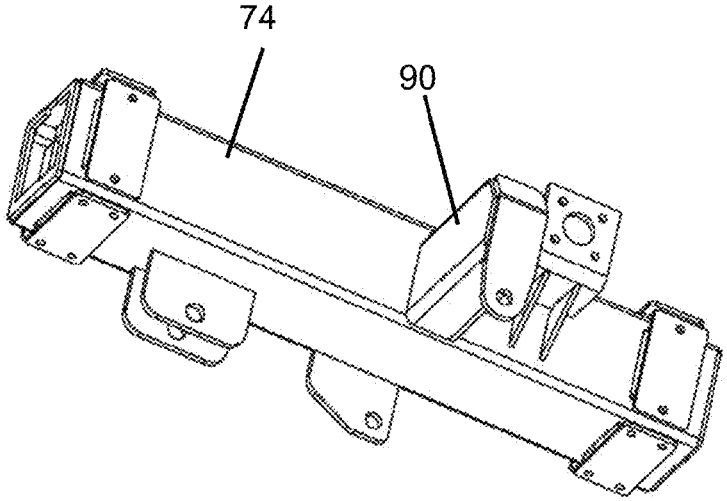
FIG. 17 is a second perspective view of a ballast end cover assembly of the ballast arm assembly.

In certain embodiments, the second end region 84 has an L-shaped configuration, as illustrated in FIG. 15, where one of the legs is attached to the central region 80 and the other leg extends away from the central region 80 so that it can be embedded into the ground beneath the water. To increase the strength of the second end region 84, at least one reinforcing plate 86 may be attached thereto.

The ballast arm mounting mechanism 74 pivotally and slidably mounts the ballast arm 72 with respect to the frame 26. The ballast arm mounting mechanism 74 has an elongated configuration with a channel extending therethrough, which is adapted to receive the ballast arm 72.

An arm 90 extends from the ballast arm mounting mechanism 74. The arm 90 is used to pivotally attach the ballast arm mounting mechanism 74 to the frame 26. A hydraulic cylinder (not shown) extends between the ballast arm mounting mechanism 74 and the frame 26 to control pivoting of the ballast arm mounting mechanism 74 with respect to the frame 26. The hydraulic cylinder is operably attached to the control system 46.

Sliding of the ballast arm 72 with respect to the ballast arm mounting mechanism 74 is controlled using a hydraulic motor 92 that is attached to the ballast arm mounting mechanism 74. The hydraulic motor 92 includes a sprocket that engages the chain attached to the ballast arm 72. The hydraulic motor 92 is operably attached to the control system 46.

In operation, the lift arm assembly 20 is initially in the lowered configuration with the lift arms 24 in the refracted position and the ballast arm assembly 70 in the lowered configuration. The initial configuration minimizes the overall size of the watercraft 10 with lifting apparatus 12.

The lift arm assembly 20 is pivoted and the lift arms 24 are extended until the lift arms 24 engage an object that is to be lifted out of the water. Thereafter, the lift arm assembly 20 is pivoted back to the lowered configuration to lift the object out of the water. If necessary, the ballast arm assembly 70 can be pivoted and extended to enhance the stability of the watercraft during the process of lifting the object out of the water.

Next, the watercraft 10 is propelled to a location to which the object is to be moved. Depending on the height of this location, the lift arm assembly can be pivoted upwardly or downwardly until the object is lowered on to the surface. The lift arms 24 are retracted and the moving process is completed.

Another embodiment of the invention is directed to a lifting apparatus that is fabricated separately from the watercraft. The components of this embodiment are similar to the components in the embodiment described with respect to FIGS. 1-17.

An advantage of forming the lifting apparatus separately from the watercraft is that the lifting apparatus can be readily attached to a variety of watercrafts depending on factors such as the situation where it is intended to use the lifting apparatus or the watercraft already in possession of the entity/person that intends to use the lifting apparatus.

Another benefit of fabricating the lifting apparatus separately from the watercraft is that the lifting apparatus can be selectively attached to the watercraft. This configuration thereby enables the watercraft to be used for other purposes when it is not desired to use the lifting apparatus.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A watercraft with lifting apparatus comprising:

a watercraft; and a lifting apparatus comprising:

a frame mounted to the watercraft;

a lift frame assembly having a first end and a second end;

a first engagement mechanism that is capable of causing the first end of the lift frame assembly to engage the frame;

a second engagement mechanism that is capable of causing the second end of the lift frame assembly to engage the frame; and a pivot mechanism that engages the lift frame assembly intermediate the first engagement mechanism and the second engagement mechanism, wherein the second end of the lift frame assembly pivots with respect to the frame when the first engagement mechanism engages the first end of the lift frame assembly and wherein the first end of the lift frame assembly pivots with respect to the frame when the second engagement mechanism engages the lift frame assembly.

2. The watercraft with lifting apparatus of claim 1, wherein the lift frame assembly comprises:

first and second side rails that each have a first end and a second end;

a first end rail extending between the first and second side rails proximate the first ends thereof;

a second end rail extending between the first and second side rails proximate the second ends thereof; and a center rail extending between the first and second side rails intermediate the first and second ends.

3. The watercraft with lifting apparatus of claim 1, wherein the pivot mechanism comprises:

a first pivot arm operably attached to the frame;

a second pivot arm operably attached to the lift frame assembly and the first pivot arm; and at least one hydraulic cylinder attached to the frame and at least one of the first pivot arm and the second pivot arm.

4. The watercraft with lifting apparatus of claim 1, and further comprising first and second lift arms operably mounted with respect to the lift frame assembly.

5. The watercraft with lifting apparatus of claim 4, wherein the first and second lift arms are slidably mounted to the lift frame assembly for movement between a retracted position and an extended position.

6. The watercraft with lifting apparatus of claim 4, wherein the first and second lift arms each comprise:

a central region having a first end and a second end;

a tip region extending from the first end of the central region; and a caster assembly attached to the second end of the central region.

7. The watercraft with lifting apparatus of claim 1, wherein the lifting apparatus further comprises a ballast arm assembly operably mounted with respect to the frame.

8. The watercraft with lifting apparatus of claim 7, wherein the ballast arm assembly comprises:

a ballast arm mounting mechanism that is pivotally attached to the frame; and a ballast arm that is slidable mounted with respect to the ballast arm mounting mechanism.

9. The watercraft with lifting apparatus of claim 7, wherein at least one of pivoting of the lifting frame assembly and movement of the ballast arm assembly with respect to the frame is controlled with a hydraulic or pneumatic system.

10. A watercraft with lifting apparatus comprising:

a watercraft; and a lifting apparatus comprising:

a frame mounted to the watercraft;

a lift frame assembly having a first end and a second end;

first and second lift arms operably mounted with respect to the lift frame assembly for movement between a retracted position and an extended position;

a first engagement mechanism that is capable of causing the first end of the lift frame assembly to engage the frame;

a second engagement mechanism that is capable of causing the second end of the lift frame assembly to engage the frame;

a pivot mechanism for causing the lift frame assembly to pivot with respect to the frame; and a ballast arm assembly slidably and pivotally mounted with respect to the frame.

11. The watercraft with lifting apparatus of claim 10, wherein the lift frame assembly comprises:

first and second side rails that each have a first end and a second end;

a first end rail extending between the first and second side rails proximate the first ends thereof;

a second end rail extending between the first and second side rails proximate the second ends thereof; and a center rail extending between the first and second side rails intermediate the first and second ends.

12. The watercraft with lifting apparatus of claim 10, wherein the pivot mechanism comprises:

a first pivot arm operably attached to the frame;

a second pivot arm operably attached to the lift frame assembly and the first pivot arm; and at least one hydraulic cylinder attached to the frame and at least one of the first pivot arm and the second pivot arm.

13. The watercraft with lifting apparatus of claim 1, wherein the first and second lift arms each comprise:

a central region having a first end and a second end;

a tip region extending from the first end of the central region; and a caster assembly attached to the second end of the central region.

14. A method of moving objects using a watercraft with lifting apparatus, wherein the method comprises:

providing a watercraft;

providing a lifting apparatus comprising a frame, a lift frame assembly, a first engagement mechanism, a second engagement mechanism and a pivot mechanism, wherein the lift frame assembly has a first end and a second end;

attaching the frame to the watercraft;

pivoting the second end of the lift frame assembly with respect to the frame using the pivot mechanism when the first engagement mechanism engages the first end of the lift frame assembly; and pivoting the first end of the lift frame assembly with respect to the frame using the pivot mechanism when the second engagement mechanism engages the second end of the lift frame assembly.

15. The method of claim 14, wherein the lift frame assembly comprises:

first and second side rails that each have a first end and a second end;

a first end rail extending between the first and second side rails proximate the first ends thereof;

a second end rail extending between the first and second side rails proximate the second ends thereof; and a center rail extending between the first and second side rails intermediate the first and second ends.

16. The method of claim 14, wherein the pivot mechanism comprises:

a first pivot arm operably attached to the frame;

a second pivot arm operably attached to the lift frame assembly and the first pivot arm; and at least one hydraulic cylinder attached to the frame and at least one of the first pivot arm and the second pivot arm.

17. The method of claim 14, and further comprising operably mounting first and second lift arms with respect to the lift frame assembly for movement between a retracted position and an extended position, wherein the first and second lift arms each comprise a central region, a tip region and a caster assembly, wherein the central region has a first end and a second end, wherein the tip region extends from the first end of the central region and the caster assembly is attached to the second end of the central region.

18. The method of claim 14, and further comprising operably mounting a ballast arm assembly to the frame, wherein the ballast arm assembly comprises a ballast arm mounting mechanism and a ballast arm, wherein the ballast arm mounting mechanism is pivotally attached to the frame and wherein the ballast arm is slidably mounted with respect to the ballast arm mounting mechanism.

19. The method of claim 18, wherein at least one of pivoting of the lifting frame assembly and movement of the ballast arm assembly with respect to the frame is controlled with a hydraulic or pneumatic system.

* * * * *